United States Patent [19]

Takeda

[11] Patent Number: 4,955,352

[45] Date of Patent: Sep. 11, 1990

[54] COMBINED SUPERCHARGER AND SUPERCHARGER COOLANT PUMP FOR AN INTERNAL COMBUSTION ENGINE

[75] Inventor: Toshio Takeda, Nagoya, Japan

[73] Assignee: Aisin Seiki Kabushiki Kaisha, Kariya, Japan

[21] Appl. No.: 310,586

[22] Filed: Feb. 15, 1989

[30] Foreign Application Priority Data

Feb. 26, 1986 [JP] Japan ..... 63-023785
Feb. 26, 1988 [JP] Japan ..... 63-023784

[51] Int. Cl.[5] ..... F02B 33/38; F04C 29/04

[52] U.S. Cl. ..... 123/559.1; 418/3; 418/88

[58] Field of Search ..... 123/559.1, 563; 418/3, 418/85, 88, 206

[56] References Cited

U.S. PATENT DOCUMENTS

| | | | |
|---|---|---|---|
| 1,287,268 | 12/1918 | Edwards | 123/238 |
| 1,344,331 | 6/1920 | Carrey | 418/131 |
| 1,669,050 | 5/1928 | Grant | 418/88 X |
| 1,743,583 | 1/1930 | Wiltse | 418/3 |
| 4,180,032 | 12/1979 | Plegat | 123/563 |

FOREIGN PATENT DOCUMENTS

| | | | |
|---|---|---|---|
| 1067466 | 1/1954 | France | 123/563 |
| 554916 | 6/1958 | Italy | 123/559.1 |
| 73304 | 6/1979 | Japan | 418/3 |
| 51724 | 3/1987 | Japan | 418/88 |
| 78391 | 5/1987 | Japan . | |
| 53490 | 4/1989 | Japan . | |

*Primary Examiner*—Michael Koczo

*Attorney, Agent, or Firm*—Oblon, Spivak, McClelland, Maier & Neustadt

[57] ABSTRACT

A combined compressor and pump has two parallel shafts journalled in a housing having a compressible fluid inlet and a compressible fluid outlet. Rotors are mounted on each of the shafts for forming a roots type compressor and compressing fluid from the compressible fluid inlet. One shaft of the compressor, which forms a supercharger for an engine, is driven by the engine, and the other shaft is driven in synchronization therewith by a pair of meshing gears mounted on the shafts, the meshing gears being constructed so as to form a gear pump. A coolant circulates within a coolant jacket in the housing and is circulated by the gear pump. The heated coolant may be circulated through a closed loop including a heat exchanger and a bypass passage for bypassing the heat exchanger during low temperature operating conditions.

5 Claims, 5 Drawing Sheets

COMBINED SUPERCHARGER AND SUPERCHARGER COOLANT PUMP FOR AN INTERNAL COMBUSTION ENGINE

BACKGROUND OF THE INVENTION

1. Field of the Invention

This invention relates to a compressor, and more particularly to a compressor having a coolant jacket and pump, to be used for a general industrial compressor or a mechanical supercharger for an engine.

2. Description of the Prior Art

In case that a fluid is generally compressed or pressurized by using a compressor, the temperature of the fluid is increased. Consequently, the compressed fluid is cooled by an intercooler if the compressor is, for example, used as a mechanical type supercharger for an engine.

A conventional mechanical type supercharger is exemplarily disclosed in Japanese Utility Model Laid Open No. 62(1987)-78391, as shown in FIGS. 7 and 8. There, a housing is provided with an inlet 1*a* and an outlet 1*b*. A pair of rotors 2, 3 are rotatably supported by bearings in bearing housings 4, 5 at forward and rearward end portions thereof within the housing 1, respectively, and a pair of gears 6, 7 are provided at end portions of rotors 2, 3 and are engaged with each other. A jacket 1*c* is disposed within the housing 1 and bearing housings 4, 5, and an external cooling water circuit communicates with the jacket 1*c*. When the supercharger 8 in FIGS. 7, 8 is assembled in a system as in FIG. 6, the water passages in the jacket communicate with a heat exchanger (radiator) 9 and a water pump 10 in the fluid circuit.

Further, a conventional compressor which is exemplarily disclosed in Japanese Patent Laid Open No. 61-182420, as shown in FIG. 9, is used as a supercharger at an intake of an engine. A crankshaft 15 of an engine 11 is rotatably driven by the reciprocating movement of a piston 13 within a cylinder 12 via a connecting rod 14. At an upper portion of a combustion chamber 16 defined by the cylinder 12 and piston 13, a main inlet port 17, port 18 and outlet port 19 are provided.

A charge passage 22 separates from a main inlet passage 21 downstream of an air-flow meter 20 and is connected to the charge port 18 at the upstream end thereof. A supercharger 23 in charge passage 22 comprises an air pump of a vane type and pressurizes air from the main inlet passage 21. The supercharger 23 is driven by the crankshaft 15 via a transmitting member 24 such as a belt, chain etc. and the pressurized air is supplied to the charge port 18. A sub-intake valve 25 is opened and closed in synchronization with the crankshaft 15. The sub-intake valve 25 is opened so as to provide a charge between the end of the intake via the main intake valve 26 and the beginning of the compression stroke and is closed with a delay of a predetermined value as compared to the main intake valve. In the charge passage 22 downstream of the supercharger 23 are disposed an intercooler 27 for cooling the pressurized air, surge tank 28 for accumulating the pressurized air, a rotary type timing valve 30 driven in synchronization with the crankshaft 15 via a transmitting member 29 such as a belt, chain etc., and a charge valve 31.

When a conventional intercooler is used, a pressure loss is generated by the intercooler, a space is required for locating the intercooler and the fluid plumbing becomes complicated. In the supercharger 8 in FIG. 8, a jacket is interposed within housings 1, 4, 5 in order to circulate the cooling water. However, a water pump 10 (FIG. 6) is independently required and a space is required for the water pump 10 thereby increasing the cost therefor.

Furthermore, when the air temperature is increased upon compression by the supercharger without intercooling, the downstream plumbing could burn to the touch and it is impossible to decrease the plumbing diameter at the discharge side of the supercharger due to the increased volume of air. When connected to an engine, knocking of the engine is generated due to the high intake temperature and the volumetric efficiency of the engine is lowered by the increased air volume, thereby minimizing the improvement of the output.

When the intercooler 27 is utilized at a discharge portion of the supercharger 23 in order to decrease the temperature of the discharged air as shown in FIG. 9, there are the following problems.

The intercooler has to be located in the path of cooling air flow in an air-to-air type intercooler, so that the locating position is restricted, the plumbing becomes longer and complicated, and the intercooler becomes large in size.

In a water cooled type intercooler, a pump is required for circulating the water and the construction of the intercooler becomes complicated.

SUMMARY OF THE INVENTION

Accordingly, it is an object of the present invention to provide a compressor which eliminates the drawbacks of the known compressor and is capable of restraining the temperature increase of the air comprised by the compressor.

It is another object of the present invention to provide a combined compressor and gear pump which is capable of restraining the temperature increase of the air compressed by the compressor while maintaining compactness and without requiring complicated fluid plumbing.

According to the present invention, the above and other objects are achieved by a combined compressor and pump including a housing having a compressible fluid inlet and a compressible fluid outlet, within which are journalled two parallel shafts having rotors mounted thereon, the rotors cooperating for compressing a fluid from the compressible fluid inlet. One of the shafts is driven in rotation, and the rotational driving force is transferred to the other shaft by meshing gears mounted on the shafts, so that the rotors can be rotated in synchronization for compressing the fluid from the inlet. The housing also includes an internal incompressible fluid circuit which communicates with the meshing gears, wherein the meshing gears comprise a gear pump for circulating the incompressible fluid in the incompressible fluid circuit.

According to a feature of the invention, the internal incompressible fluid circuit includes a coolant jacket which at least partially surrounds the rotors, so that the fluid compressed by the rotors is cooled by the incompressible fluid in the jacket.

According to another feature of the invention, an external incompressible fluid circuit connects to the coolant jacket for circulating the incompressible fluid in a closed loop. The external compressible fluid circuit includes a heat exchanger and a bypass passage. A changeover valve in the external circuit selectively controls fluid flow to either the heat exchanger or a bypass passage which bypasses the heat exchanger.

Preferably, the compressible fluid outlet of the compressor is connected to an internal combustion engine, so that the compressor constitutes a supercharger for the engine. In this case, the rotational drive force to one of the shafts of the compressor is supplied by the engine.

BRIEF DESCRIPTION OF THE DRAWINGS

The above and other objects, features and advantages of the present invention will become fully apparent from the following description taken in conjunction with the acompanying drawings, in which.

DESCRIPTION OF THE PREFERRED EMBODIMENT

Figure 9:
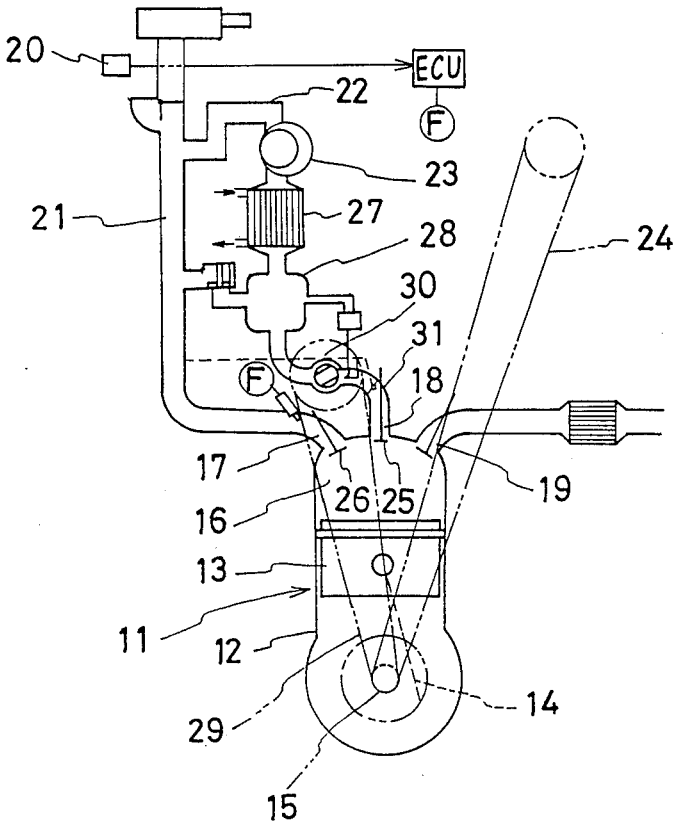
FIG. 9 is a view showing an engine with a conventional supercharger.

Referring first to FIGS. 1–4, a housing 43 of the compressor has bearings 44*a* and 44*b* which rotatably support a shaft 40*a* extending through a compression chamber defined in the housing. A parallel shaft 40*b* is rotatably supported in the housing by bearings 44*b* and 45*b*. Rotors 46*a* and 46*b* are fixedly connected to the shafts 40*a* and 40*b*, and can rotate in synchronization with one another to form a roots type compressor, and so compress air between the compressible fluid inlet and the compressible fluid outlet indicated by arrows in FIG. 2. Although not shown in the figures, the compressible fluid outlet can be connected to the intake system of an engine, as is the case for the conventional compressor 23 of FIG. 9.

A pulley 12 is mounted to one end of the shaft 40*a* for rotating the shaft 40*a*. The pulley 12 is driven by the engine via a drive transmitting member such as a belt. Rotation of the shaft 40*b* in synchronization with the rotation of the shaft 40*a* is provided by a pair of meshing gears 41*a* and 41*b* which are respectively fixedly mounted on the other ends of the shafts 40*a* and 40*b*, and which are constructed so as to form a gear pump within a casing 47 fluid tightly mounted to an end of the housing and forming part of the housing.

A coolant jacket 50 is formed in the housing 43 and surrounds the compression chamber, so that heat generated by compression can be removed by coolant in the jacket. A coolant inlet port 49 connects to the casing 47 for supplying an incompressible coolant fluid such as oil to the gear pump formed by the gears 41*a* and 41*b*. The coolant fluid in the casing 47 can communicate with the coolant jacket 50 via ports 56, and can be discharged from the coolant jacket via the outlet port 48 in the housing. There is thus formed in the housing an internal incompressible fluid circuit into which an incompressible coolant is sucked through the inlet port 49 by the pumping action of the gears 41*a* and 41*b*, is pumped to the cooling jacket 50 for removing heat from the compressor, and is discharged from the housing via the outlet port 48. The gears 41*a* and 41*b* thus simultaneously provide both synchronized drive between the rotors 46*a* and 46*b*, and pumping for the compressor coolant.

Element 53 is an oil seal for preventing oil leakage into the compression chamber of the compressor.

Figure 1:
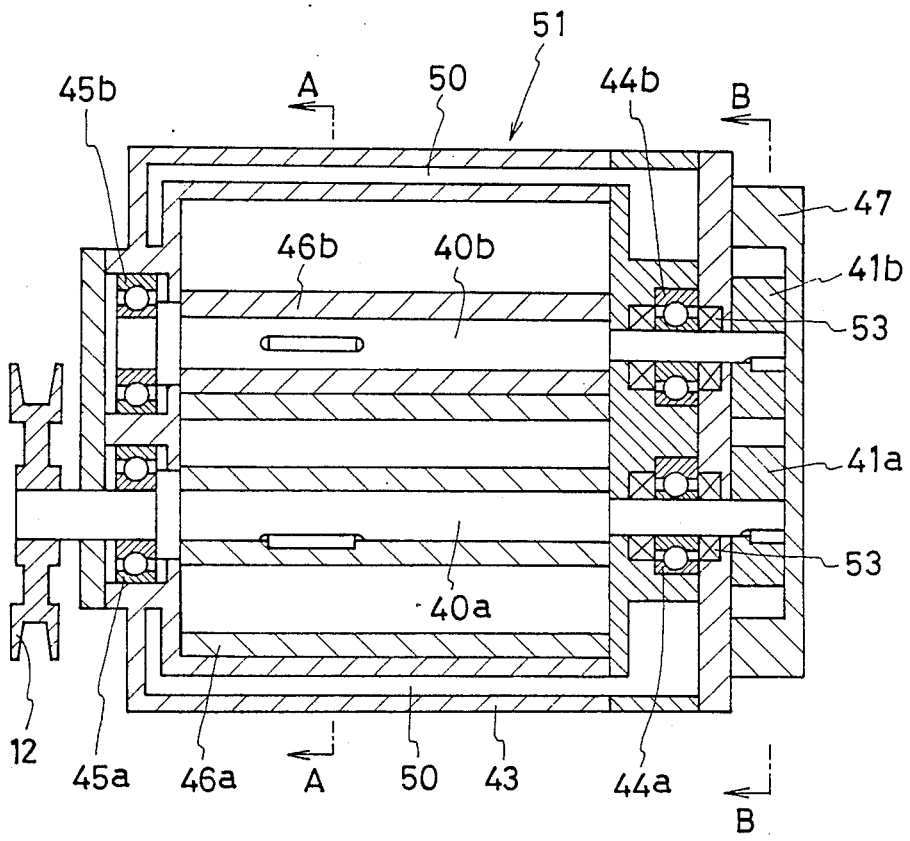
FIG. 1 is a front sectional view of an embodiment according to the present invention.
Figure 2:
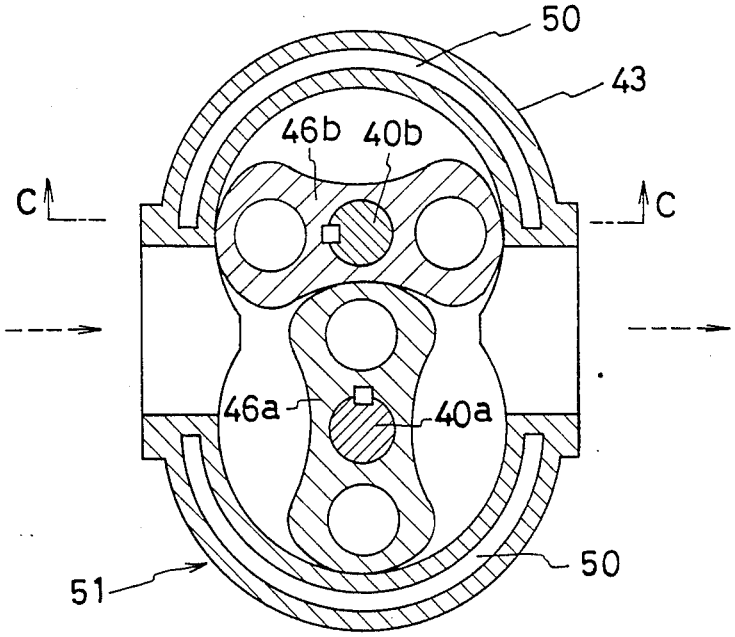
FIG. 2 is a sectional view taken along the line A—A in FIG. 1.
Figure 3:
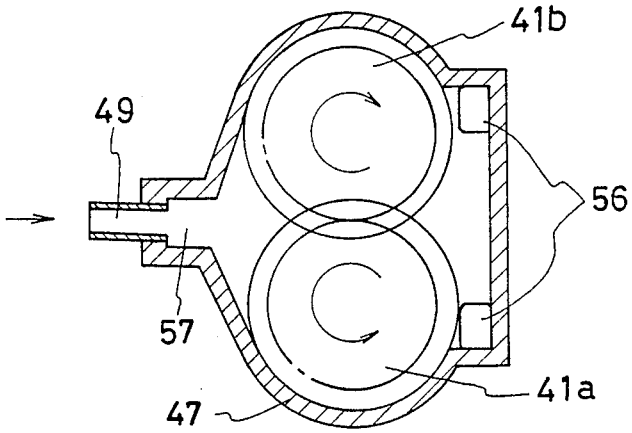
FIG. 3 is a sectional view taken along the line B—B in FIG. 1.
Figure 4:
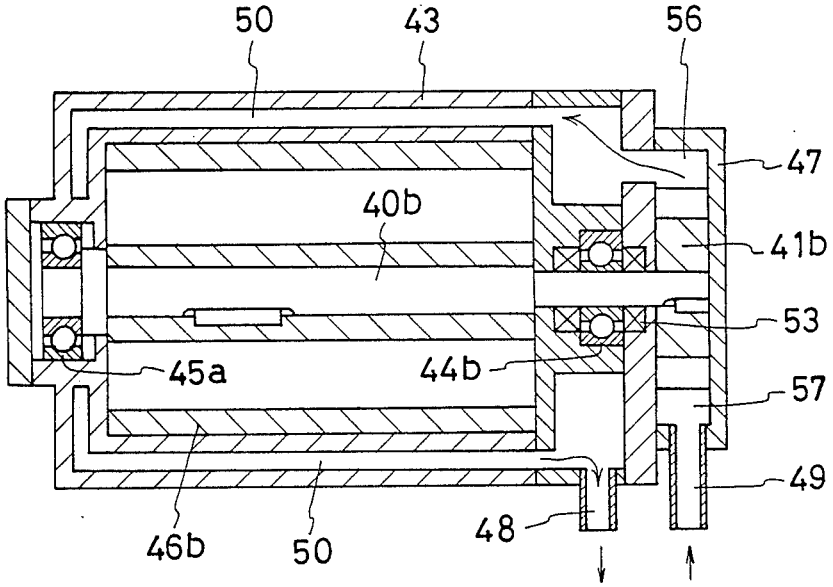
FIG. 4 is a sectional view taken along the line C—C in FIG. 2.
Figure 5:
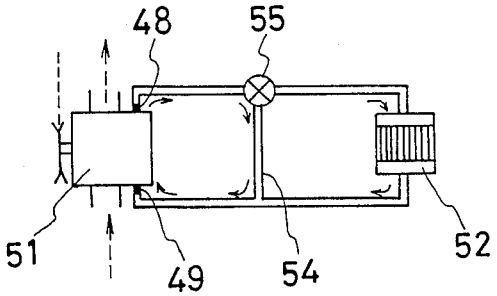
FIG. 5 is a view of a system using a compressor according to the present invention.
Figure 6:
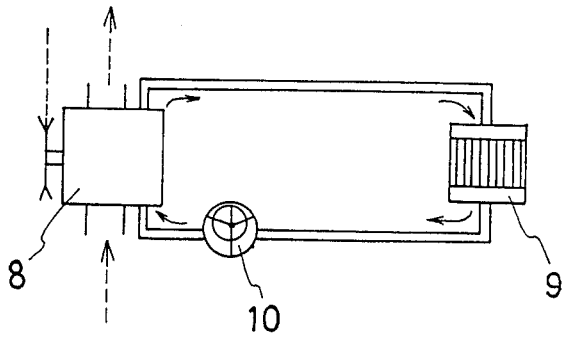
FIG. 6 is a view similar to FIG. 5, but using a conventional supercharger.
Figure 7:
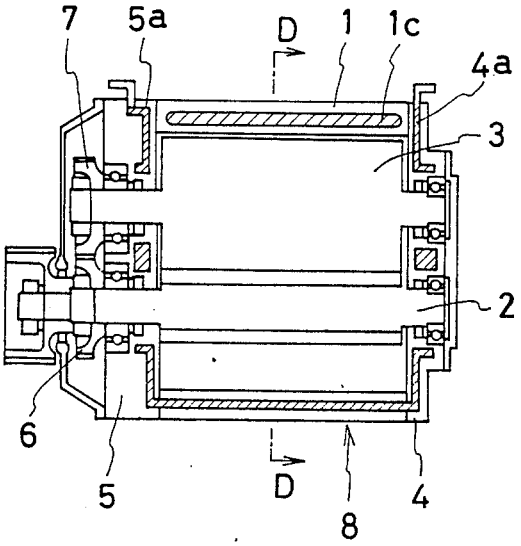
FIG. 7 is a view similar to FIG. 1, but showing a conventional supercharger.
Figure 8:
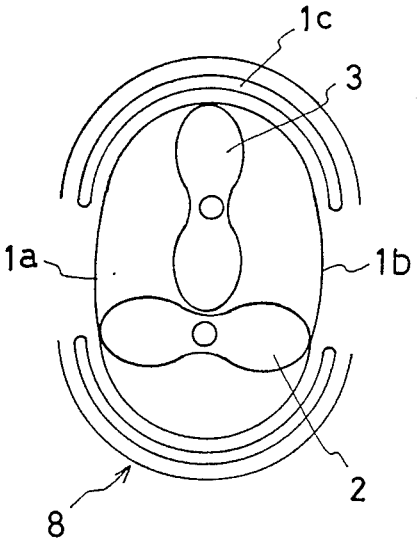
FIG. 8 is a view similar to FIG. 2, but taken along the line D—D in FIG. 7.

Referring to FIG. 5, the inlet port 49 and the outlet port 48 connect to an external incompressible fluid circuit which forms a closed loop for circulating the coolant. A heat exchanger 52, i.e., an oil cooler, is formed in the circuit, so that heat transferred to the coolant from the compressor can be removed.

A changeover valve 55 is mounted in the external incompressible fluid circuit and can be positioned to either permit the flow of oil to the heat exchanger 52, or to bypass the coolant oil to the bypass passage 54, for reasons to be explained below.

The operation of the compressor according to the invention used as a supercharger for an engine is as follows:

Rotation of the shaft 40*a* by the engine via the pulley 12 simultaneously rotates the shaft 40*b* via the gears 41*a* and 41*b*, so that the rotors 46*a* and 46*b* rotate in synchronization for compressing air to be fed to an engine intake system. The rotation of the gears 41*a* and 41*b* for driving the rotors in synchronization also pumps cooling oil through the cooling jacket 50, and so circulates oil through the external incompressible fluid circuit shown in FIG. 5. If the changeover valve 55 is positioned so as to permit fluid flow through the heat exchanger 52, coolant is cooled in the heat exchanger 52 before returning to the inlet port 49.

During low temperature operating conditions, the viscosity of the oil is high, and so pumping the oil increases the parasitic drag of the compressor. The changeover valve 55 can therefore include a sensor (not shown) for sensing the temperature or viscosity of the oil and may be controlled by a controller (not shown) which causes the changeover valve 55 to bypass the oil through the bypass passage 54 until the sensed temperature or viscosity of the oil has reached a desired value. This shortens the warm-up period of the compressor where the parasitic drag is high, and improves the overall efficiency of the supercharger. It also contributes to a rapid warm-up of the engine since a high temperature compressed air delivered to the engine from the supercharger.

As described above, the gear pump is constructed by gears which drive the compressor so that the oil is pumped to the coolant jacket within the housing, thereby cooling the compressor. Therefore, it is not required to separately provide a pump for the circulation of the coolant, as in the conventional system. The compressed air is not cooled by an intercooler, but by the coolant in the jacket, so that a pressure loss for the compressed fluid as in an intercooler is not generated. As a result, no intercooler is needed and the compressor must perform less work.

Further, the bypass passage 54 is disposed in the external circuit for circulating the coolant oil and the valve 55 is provided for changing the external circuit flow between the heat exchanger and the bypass passage, so that the oil does not flow to the heat exchanger during the cold state of the oil and is circulated through the bypass passage by the change of the valve. Accordingly, when the compressor is utilized as a supercharger of an engine, the compressed fluid is not overcooled. Additionally, the speed of increase of the oil temperature is faster, so that the viscosity of the oil is quickly lowered and the resistance of the oil is lowered. As a result, the horsepower consumed by the compressor is reduced.

Although the invention has been described in its preferred form with a certain degree of particularity, obviously many changes and variations are possible therein. It is therefore to be understood that the present invention may be practiced otherwise than specifically described herein without departing from the scope and spirit thereof.

What is claimed as new and desired to be secured by Letters Patent of the United States is:

1. A combined supercharger compressor and pump for an internal combustion engine, comprising:

a housing having a compressible fluid inlet and a compressible fluid outlet connected to an internal combusion engine;

two parallel shafts journalled in said housing:

rotors mounted on each of said shafts and cooperating for compressing a fluid from said compressible fluid inlet;

means for supplying a rotational drive force from said engine to one of said shafts;

meshing gears in said housing and mounted on said shafts for transmitting rotational drive force from said one of said shafts to the other of said shafts;

an internal incompressible coolant fluid circuit in said housing, said meshing gears being positioned in said internal incompressible coolant fluid circuit, wherein said meshing gears comprise a gear pump for circulating an incompressible coolant fluid in said internal incompressible coolant fluid circuit, wherein said internal incompressible coolant fluid circuit is independent of a coolant circuit of said internal combustion engine and includes a coolant jacket in said housing and at least partially surrounding said rotors, whereby the compressed fluid is cooled by an incompressible coolant fluid in said jacket;

an external incompressible coolant fluid circuit communicating with said coolant jacket for circulating an incompressible coolant fluid in a closed loop with said internal incompressible coolant fluid circuit; and a heat exchanger in said external incompressible coolant fluid circuit for cooling an incompressible coolant fluid therein, whereby the compressor can be sufficiently cooled to cool the compressible fluid being compressed thereby.

2. The combined compressor and pump of claim 1, including a bypass passage in said external incompressible fluid circuit for bypassing said heat exchanger, and a changeover valve in said external incompressible fluid circuit for selectively communicating said coolant jacket with one of said heat exchanger and said bypass passage.

3. The combined compressor and pump of claim 1, wherein said compressible fluid outlet is connected to an internal combustion engine, whereby said compressor is a supercharger for said engine.

4. The combined compressor and pump of claim 3, wherein said means for supplying a rotational drive force to one of said shafts is a pulley mounted on said one of said shafts and driven by said engine.

5. The combined compressor and pump of claim 1, wherein said means for supplying a rotational drive force to one of said shafts is a pulley mounted on said one of said shafts and driven by said engine.

* * * * *

UNITED STATES PATENT AND TRADEMARK OFFICE

CERTIFICATE OF CORRECTION

PATENT NO. : 4,955,352

DATED : SEPTEMBER 11, 1990

INVENTOR(S) : TOSHIO TAKEDA

It is certified that error appears in the above-identified patent and that said Letters Patent is hereby corrected as shown below:

On the Title page item [30]:

In the Foreign Application Priority Data, please delete "Feb. 26, 1986" and insert --Feb. 26, 1988--.

Signed and Sealed this

Fifteenth Day of September, 1992

*Attest:*

DOUGLAS B. COMER

*Attesting Officer*

*Acting Commissioner of Patents and Trademarks*